US006167946B1

(12) United States Patent
Uchikawa et al.

(10) Patent No.: US 6,167,946 B1
(45) Date of Patent: Jan. 2, 2001

(54) HEAT EXCHANGER MOUNTED TO VEHICLE

(75) Inventors: Akira Uchikawa, Nagoya; Satomi Muto, Nishikasugai; Takaaki Sakane, Nagoya, all of (JP)

(73) Assignee: Denso Corporation, Kariya (JP)

( * ) Notice: Under 35 U.S.C. 154(b), the term of this patent shall be extended for 0 days.

(21) Appl. No.: 09/532,990

(22) Filed: Mar. 22, 2000

(30) Foreign Application Priority Data

Mar. 30, 1999 (JP) ..... 11-089795

(51) Int. Cl.[7] ..... F16F 1/34

(52) U.S. Cl. ..... 165/71; 165/67; 165/149; 165/178; 251/144; 123/41.14; 123/41.54

(58) Field of Search ..... 165/67, 69, 71, 165/149, 81, 82, 178, 104.32; 123/41.14, 41.51, 41.54; 251/144

(56) References Cited

U.S. PATENT DOCUMENTS

| | | | | |
|---|---|---|---|---|
| 2,613,064 | * | 10/1952 | Huffman | 165/71 X |
| 4,006,775 | * | 2/1977 | Avrea | 123/41.54 X |
| 4,449,692 | * | 5/1984 | Rhodes | 165/71 X |
| 4,612,977 | * | 9/1986 | Hayashi et al. | 165/71 |
| 4,753,289 | * | 6/1988 | Avrea | 165/104.32 X |
| 5,246,202 | * | 9/1993 | Beamer | 165/71 X |
| 5,325,914 | * | 7/1994 | Tanaka | 165/67 |
| 5,429,182 | * | 7/1995 | Hanafusa | 165/67 |
| 5,975,197 | * | 11/1999 | Kado | 165/67 X |

FOREIGN PATENT DOCUMENTS

| | | | | |
|---|---|---|---|---|
| 401159548 | * | 6/1989 | (JP) | 165/71 |
| 406249454 | * | 9/1994 | (JP) | 165/71 |
| Y2-7-54019 | | 12/1995 | (JP) . | |

* cited by examiner

*Primary Examiner*—Christopher Atkinson
(74) *Attorney, Agent, or Firm*—Harness, Dickery & Pierce, PLC

(57) ABSTRACT

A radiator includes a core portion, a header tank, a side plate attached to the core portion and a bracket through which the radiator is mounted to a vehicle. The bracket is separately formed from the header tank, and is connected to the side plate through a bolt. As a result, the radiator is readily mounted to a vehicle of a different model by only changing an attachment position of the bracket to the radiator, without modifying the header tank. Further, the bracket includes a coolant receiving portion disposed to face a drain outlet of the header tank with a predetermined gap therebetween. Therefore, coolant discharged from the header tank collides with the coolant receiving portion to reduce its dynamic pressure. As a result, coolant drained from the radiator is restricted from being scattered.

15 Claims, 3 Drawing Sheets

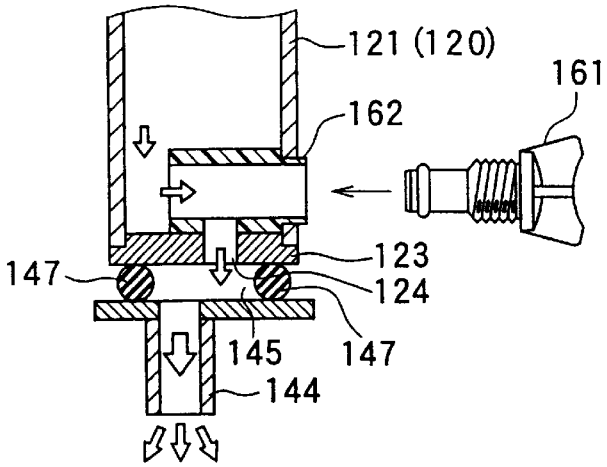
FIG. 3
FIG. 4
PRIOR ART
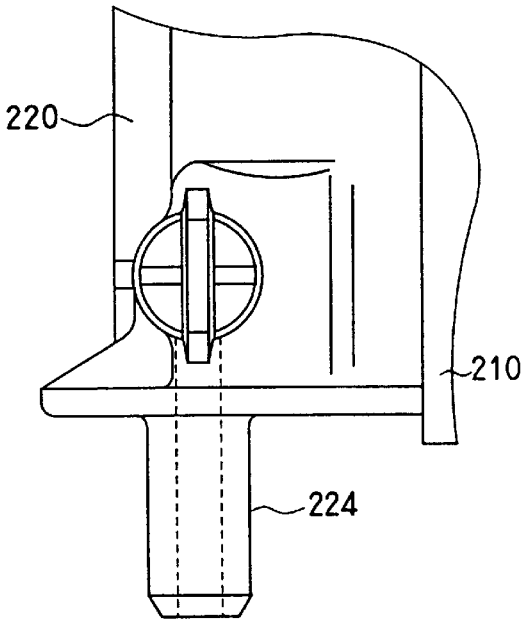
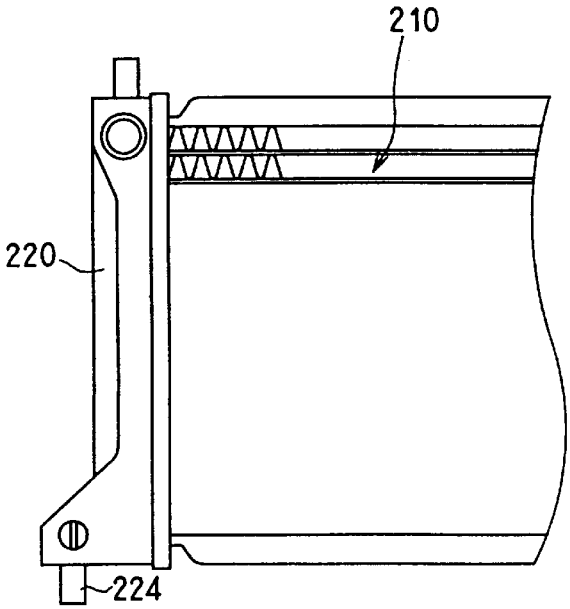
FIG. 5
PRIOR ART

HEAT EXCHANGER MOUNTED TO VEHICLE

CROSS REFERENCE TO RELATED APPLICATIONS

This application relates to and claims priority from Japanese Patent Application No. 11-89795 filed on Mar. 30, 1999, the contents of which are hereby incorporated by reference.

BACKGROUND OF THE INVENTION

1. Field of the Invention

The present invention relates generally to heat exchangers which perform heat exchange of fluid, and particularly to a radiator for a vehicle which radiates heat of engine coolant of a water-cooled engine of the vehicle into atmospheric air.

2. Related Art

Conventionally, as shown in FIG. 4, a radiator for a vehicle is mounted to the vehicle through an attachment pin 224 having a drain passage therein. Coolant in the radiator is drained through the drain passage in the attachment pin 224. However, the attachment pin 224 is integrally formed with a header tank 220 of the radiator. Therefore, when the radiator is mounted to a vehicle of a different model and an insertion position of the attachment pin 224 to the vehicle differs, the header tank 220 may need to be modified even when a size of a core portion 210 of the radiator does not need to be changed. As a result, parts of the radiator may need to be made in various types, thereby increasing a manufacturing cost of the radiator. On the other hand, when the header tank 220 is made in a small number of types, a design of the vehicle may need to be modified according to the radiator. As a result, design of the vehicle is largely limited, and mountability of the radiator to the vehicle declines.

Further, recently, whole parts of the radiator are demanded to be made of metal such as aluminum for facilitating recycling of vehicle parts. As shown in FIG. 5, when the header tank 220 is made of resin, the header tank 220 is readily modified so that the attachment pin 224 is inserted at a different position in a vehicle of a different model. However, when the header tank 220 is made of metal, it may be difficult to form the header tank 220 into a shape shown in FIG. 5.

SUMMARY OF THE INVENTION

In view of the foregoing problems, it is an object of the present invention to provide a heat exchanger such as a radiator having an improved mountability to a vehicle and manufactured at a relatively low cost.

According to the present invention, a heat exchanger includes a core portion having a plurality of tubes through which fluid flows and a plurality of fins, a header tank communicating with the tubes, a side plate disposed at a lower end of the core portion for reinforcing the core portion, and a bracket through which the core portion and the header tank are mounted to a mounting base. The header tank has a drain outlet through which the fluid in the header tank is discharged. The drain outlet is formed at a lower end of the header tank. The bracket is connected to the side plate, and includes a fluid receiving portion for receiving the fluid from the drain outlet, and a pin portion downwardly extending from the fluid receiving portion to be inserted into the mounting base. The pin portion has a passage through which the fluid is drained. The fluid receiving portion is disposed to face the drain outlet with a predetermined gap therebetween.

As a result, since the bracket is separately formed from the header tank and is connected to the side plate, the heat exchanger is readily mounted to various mounting bases only by changing an attachment position of the bracket to the heat exchanger, without modifying the header tank. Therefore, manufacturing cost of the radiator is reduced. Further, since the fluid receiving portion is disposed to face the drain outlet with the predetermined gap therebetween, the fluid discharged from the drain outlet collides with the fluid receiving portion to reduce its dynamic pressure before being drained through the pin portion. As a result, the fluid is restricted from being scattered while being drained from the heat exchanger.

Preferably, the bracket has a wall portion upwardly extending from an end portion of the fluid receiving portion so that the fluid colliding with the fluid receiving portion is restricted from being scattered by the wall portion.

BRIEF DESCRIPTION OF THE DRAWINGS

This and other objects and features of the present invention will become more readily apparent from a better understanding of the preferred embodiment described below with reference to the accompanying drawings, in which:

FIG. 3 is an enlarged sectional view showing a lower part of a header tank of a radiator according to a modification of the present embodiment;

FIG. 4 is an enlarged schematic view showing a lower part of a header tank of a conventional radiator; and FIG. 5 is a partial front view showing the conventional radiator having the modified header tank.

DETAILED DESCRIPTION OF THE PREFERRED EMBODIMENT

A preferred embodiment of the present invention is described hereinafter with reference to the accompanying drawings. In the present embodiment, the present invention is applied to a radiator 100 which cools engine coolant of a water-cooled engine (not shown) of a vehicle.

Figure 1:
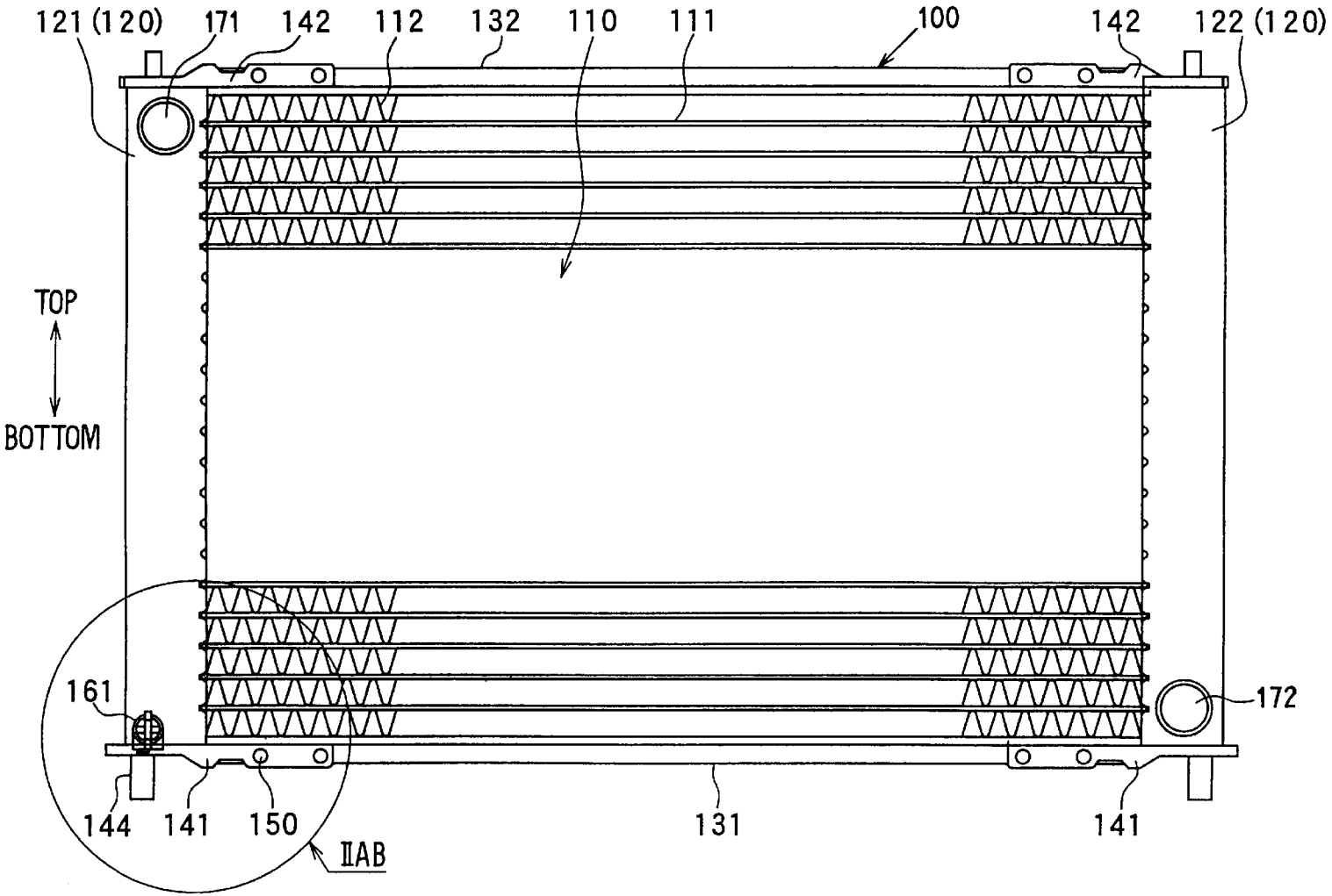
FIG. 1 is a schematic front view showing a radiator according to a preferred embodiment of the present invention.

As shown in FIG. 1, the radiator 100 includes plural flat tubes 111 through which coolant flows, and plural corrugated cooling fins 112 each of which is disposed between adjacent tubes 111 for facilitating heat exchange between coolant and air. The tubes 111 and the fins 112 form a rectangular core portion 110 of the radiator 100.

A first header tank 121 is disposed at one flow-path end (i.e., left end in FIG. 1) of the tubes 111. A second header tank 122 is disposed at the other flow-path end (i.e., right end in FIG. 1) of the tubes 111. Each of the first and second header tanks 121, 122 extends in a direction perpendicular to a longitudinal direction of the tubes 111, and communicates with the tubes 111. Coolant from the engine flows into the first header tank 121, and is distributed to each of the tubes 111. Coolant is heat-exchanged with air while flowing through the tubes 111, and is collected into the second header tank 122 to be discharged toward the engine. Hereinafter, each of the first and second header tanks 121, 122 is referred to as the header tank 120.

First and second side plates 131, 132 are respectively disposed at lower and upper ends of the core portion 110 in FIG. 1 for reinforcing the core portion 110. Each of the first and second side plates 131, 132 extends in parallel with the longitudinal direction of the tubes 111, and is formed to have a U-shaped cross-section. In the present embodiment, the tubes 111, the fins 112, the header tank 120 and the first and second side plates 131, 132 are made of aluminum, and are integrally brazed together.

Still referring to FIG. 1, at a lower end of the header tank 120, a first bracket 141 made of ferrous metal is connected to the first side plate 131 by bolts 150. The core portion 110 and the header tank 120 are mounted to a lower mounting bracket (not shown) attached to the vehicle through the first bracket 141. Similarly, at an upper end of the header tank 120, a second bracket 142 made of ferrous metal is connected to the second side plate 132 by the bolts 150. The core portion 110 and the header tank 120 are mounted to an upper mounting bracket (not shown) attached to the vehicle through the second bracket 142.

Figure 2A:
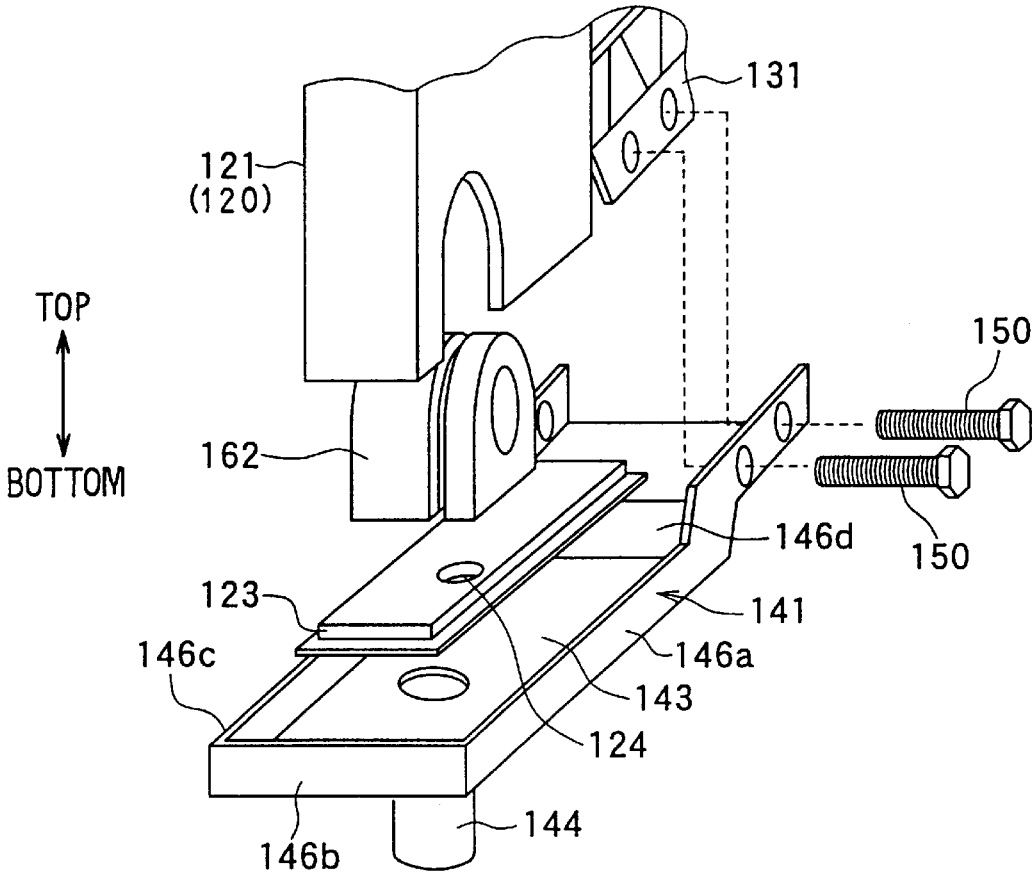
FIG. 2A is an enlarged perspective view showing a portion indicated by arrow IIAB in FIG. 1.
Figure 2B:
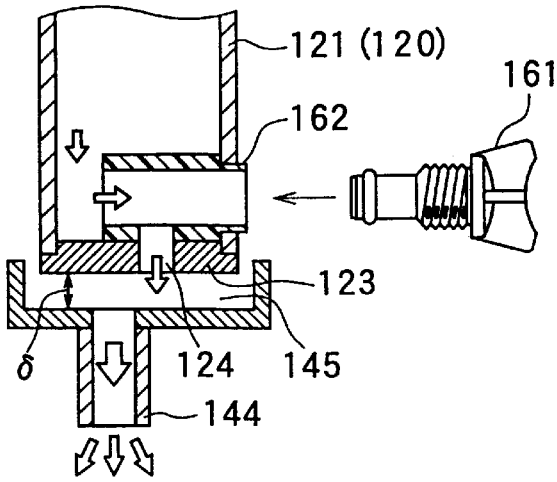
FIG. 2B is an enlarged sectional view showing a portion indicated by arrow IIAB in FIG. 1.

The first and second brackets 141, 142 are the same in shape and size thereof. Therefore, only the first bracket 141 will be described in detail. As shown in FIGS. 2A and 2B, the lower end of the header tank 120 is closed by a tank cap 123. The tank cap 123 is brazed to the header tank 120 with a resin seat cock 162 being inserted therebetween. A drain plug 161 is inserted into the seat cock 162. The first bracket 141 includes a flat coolant receiving portion 143 extending in a direction perpendicular to a top-bottom direction in FIGS. 2A and 2B (i.e., in a horizontal direction). A cylindrical pipe-shaped attachment pin portion 144 having a coolant passage therein is brazed to the coolant receiving portion 143 to extend downwardly from the coolant receiving portion 143. The pin portion 144 is inserted into the lower mounting bracket of the vehicle.

As shown in FIG. 2B, the tank cap 123 attached to the lower end of the header tank 120 is disposed to face the coolant receiving portion 143 of the first bracket 141 with a predetermined gap δ therebetween. The tank cap 123 has a drain outlet 124 through which coolant in the header tank 120 is discharged. The first bracket 141 further includes four wall portions 146*a*, 146*b*, 146*c* and 146*d* each of which respectively extends upwardly from each of four sides of the coolant receiving portion 143. The coolant receiving portion 143 and the wall portions 146*a*–146*d* form a coolant storing space 145 in which coolant discharged from the drain outlet 124 is tentatively stored. Referring back to FIG. 1, an inlet pipe 171 through which coolant is introduced into the radiator 100 is connected to an outlet of the engine, and an outlet pipe 172 through which coolant is discharged from the radiator 100 is connected to an inlet of the engine.

According to the present embodiment, the first bracket 141 is separately formed from the header tank 120, and is connected to the first side plate 131 by the bolts 150. Therefore, even when the radiator 100 is mounted to a vehicle of a different model, and each mounting position of the first and second brackets 141, 142 to the vehicle differs, the radiator 100 is readily mounted to the vehicle by only changing each attachment position of the first and second brackets 141, 142 to the radiator 100, without modifying the header tank 120. As a result, mountability of the radiator 100 to the vehicle is improved while design of the vehicle is not largely limited. Therefore, manufacturing cost of the radiator 100 is reduced.

Further, in the present embodiment, the drain outlet 124 of the header tank 120 is disposed to face the coolant receiving portion 143 with the predetermined gap δ therebetween. Therefore, coolant discharged from the drain outlet 124 once collides with the coolant receiving portion 143 to reduce dynamic pressure thereof, and then is drained through the passage formed in the pin portion 144. As a result, coolant is drained from the radiator 100 with a relatively low dynamic pressure, and is restricted from being scattered while being drained.

Thus, according to the present embodiment, mountability of the radiator 100 to the vehicle is improved and manufacturing cost of the radiator 100 is reduced, while coolant drained from the radiator 100 is restricted from being scattered. A capacity of the coolant storing space 145 is increased by increasing each of heights of the wall portions 146*a*–146*d* or an area of the coolant receiving portion 143. In this case, dynamic pressure of coolant drained from the pin portion 144 is further reduced. Therefore, preferably, each of heights of the wall portions 146*a*–146*d* and the area of the coolant receiving portion 143 are respectively set to relatively large values to such a degree that the first bracket 141 does not become too large in size. Further, the wall portions 146*a*–146*d* restrict coolant from overflowing the first bracket 141. Therefore, coolant is further restricted from being scattered from the coolant storing space 145.

Furthermore, in the present embodiment, whole parts of the radiator 100 including the header tank 120 are made of metal. Therefore, recycling of the radiator 100 is facilitated in comparison with a radiator including resin parts and metal parts. In the present embodiment, since the first and second brackets 141, 142 are separately formed from the header tank 120, the header tank 120 does not need to be modified. Therefore, even when the header tank 120 is made of metal, the radiator 100 is relatively readily manufactured.

As shown in FIG. 3, the wall portions 146*a*–146*d* may be omitted, and the coolant storing space 145 may be formed by providing a spacer such as an O-ring or a rubber bush between the coolant receiving portion 143 and the tank cap 123. Further, the first and second brackets 141, 142 may be made of stainless or aluminum and brazed to the first and second side plates 131, 132. Also, the present invention may be applied to any other heat exchanger such as a condenser.

Although the present invention has been fully described in connection with a preferred embodiment thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger capable of being mounted to a mounting base, the heat exchanger comprising:

a core portion including a plurality of tubes through which fluid flows and a plurality of fins each of which is disposed between adjacent tubes for facilitating heat exchange of the fluid;

a header tank disposed at a flow-path end of the tubes to extend in a direction substantially perpendicular to a longitudinal direction of the tubes and to communicate with each of the tubes, the header tank including a drain outlet through which the fluid in the header tank is discharged, the drain outlet being formed at a lower end of the header tank;

a side plate disposed at a lower end of the core portion to extend in parallel with the longitudinal direction of the tubes for reinforcing the core portion; and a bracket through which the core portion and the header tank are mounted to the mounting base, the bracket being connected to the side plate and including a fluid receiving portion for receiving the fluid from the drain outlet, and a pin portion downwardly extending from the fluid receiving portion to be inserted into the mounting base, the pin portion having a passage through which the fluid is drained, wherein:

the fluid receiving portion is disposed to face the drain outlet with a predetermined gap therebetween.

2. The heat exchanger according to claim 1, wherein the pin portion is formed into a pipe shape.

3. The heat exchanger according to claim 1, wherein the core portion is formed into a rectangular shape.

4. The heat exchanger according to claim 1, wherein the header tank is made of aluminum.

5. The heat exchanger according to claim 1, wherein the bracket is connected to the side plate by a bolt.

6. The heat exchanger according to claim 1, wherein the bracket has a wall portion upwardly extending from an end portion of the fluid receiving portion.

7. The heat exchanger according to claim 6, wherein the wall portion is formed along a periphery of the fluid receiving portion.

8. The heat exchanger according to claim 1, further comprising a spacer disposed between the fluid receiving portion and the lower end of the header tank to provide a space between the fluid receiving portion and the lower end of the header tank.

9. The heat exchanger according to claim 1, further comprising a tank cap for closing the lower end of the header tank, wherein the drain outlet is formed in the tank cap.

10. The heat exchanger according to claim 1, wherein the header tank and the bracket are separately formed.

11. A heat exchanger capable of being mounted to a mounting base, the heat exchanger comprising:

a core portion including a plurality of tubes through which fluid flows and a plurality of fins each of which is disposed between adjacent tubes for facilitating heat exchange of the fluid;

a header tank disposed at a flow-path end of the tubes to extend in a direction substantially perpendicular to a longitudinal direction of the tubes and to communicate with each of the tubes, the header tank including a drain outlet through which the fluid in the header tank is discharged, the drain outlet being formed at a lower end of the header tank; and a bracket through which the core portion and the header tank are mounted to the mounting base, the bracket being disposed to face the drain outlet of the header tank and to define a space with the lower end of the header tank for receiving the fluid from the drain outlet, the bracket having a pin portion downwardly extending to be inserted into the mounting base, the pin portion having a passage through which the fluid is drained from the space.

12. The heat exchanger according to claim 11, further comprising a side plate disposed at a lower end of the core portion to extend in parallel with the longitudinal direction of the tubes for reinforcing the core portion, wherein:

the bracket is connected to the side plate.

13. The heat exchanger according to claim 11, wherein the bracket has a plate-shaped fluid receiving portion for receiving the fluid, and a wall portion upwardly extending from the fluid receiving portion along a periphery of the fluid receiving portion, wherein:

the fluid receiving portion, the wall portion and the lower end of the header tank define the space.

14. The heat exchanger according to claim 11, wherein the header tank is made of aluminum.

15. The heat exchanger according to claim 11, wherein the header tank and the bracket are separately formed.

* * * * *